United States Patent [19]

Kimura

[11] Patent Number: 4,505,319

[45] Date of Patent: Mar. 19, 1985

[54] CONTINUOUS SHEET METAL CASTING DEVICE

[75] Inventor: Tomoaki Kimura, Hitachi, Japan

[73] Assignee: Hitachi, Ltd., Tokyo, Japan

[21] Appl. No.: 352,997

[22] Filed: Feb. 26, 1982

[30] Foreign Application Priority Data

Feb. 27, 1981 [JP] Japan ..... 56-27029

[51] Int. Cl.[3] ..... B22D 11/06

[52] U.S. Cl. ..... 164/432; 164/481

[58] Field of Search ..... 164/431–432, 164/436, 443, 485, 481, 491

[56] References Cited

U.S. PATENT DOCUMENTS

| | | | |
|---|---|---|---|
| 3,452,809 | 7/1969 | Dumont-Fillon | 164/432 |
| 3,860,057 | 1/1975 | Garlick | 164/481 |
| 3,955,615 | 5/1976 | Dompas | 164/432 |
| 4,367,783 | 1/1983 | Wood | 164/481 |

FOREIGN PATENT DOCUMENTS 331206 12/1955 Japan .

*Primary Examiner*—Kuang Y. Lin
*Assistant Examiner*—Richard K. Seidel
*Attorney, Agent, or Firm*—Beall Law Offices

[57] ABSTRACT

The continuous sheet metal casting device of this invention has a mold which comprises: a pair of flexible top and bottom belts traveling along with the sheet metal being cast; and a pair of side belts traveling together with the sheet metal, a part of the side belts being held between the top and the bottom belts, the other part being located on the side of one of the top and bottom belts with respect to the sheet metal. With this construction it is possible to elongate the width of the side belts without affecting the bending stress acting on the side belts and regardless of the thickness of the sheet metal. The greater width of the side belts thus obtained results in improved adhesion between the top and bottom belts and the side belts, thereby preventing the leakage of molten metal from the mold.

16 Claims, 5 Drawing Figures

CONTINUOUS SHEET METAL CASTING DEVICE

BACKGROUND OF THE INVENTION

This invention relates to a device for casting a sheet metal, particularly of a large width, by directly casting and cooling the molten metal.

The conventional method of producing steel sheets or nonferrous metal sheets of large width (for example, 2 to 30 mm in thickness, 500 to 1800 mm in width) consists of first producing a slab 200 to 250 mm thick by the slab continuous casting and then hot-rolling the slab into a sheet of desired thickness. This method, however, requires a large amount of energy for rolling process.

To overcome this drawback, a Hazelett type continuous casting machine (fore instance Japanese Patent Publication No. 33-1206) has been proposed, which has twin belts for supporting the top and bottom sides of the cast sheet metal. With this continuous casting machine, the lateral sides of the cast sheet are supported by the rotating ball-like caterpillars. When casting metals whose cooling performance is good, such as aluminum and copper, the amount of molten metal that leaks between the caterpillars is small and therefore the casting process can be performed without too great a problem. When, however, this continuous casting machine is applied to the steel material a problem arises. That is, since the thermal conductivity of steel is low the steel molten metal is difficult to be cooled, so that the molten metal easily flows between the caterpillars. Because the adhesion between the caterpillars and the belt is not sufficient, the molten metal that entered between the caterpillars will easily leak out from between the caterpillars and the belt. Thus desired casting cannot be obtained.

SUMMARY OF THE INVENTION

The object of this invention is to provide a continuous sheet metal casting device which prevents the leakage of molten metal from the mold and thereby enables the stable production of sheet metal directly from the molten metal.

To achieve this objective, the continuous sheet metal casting device of this invention has a mold which consists of: a pair of top and bottom flexible belts forming the top and bottom surfaces of the cast sheet and traveling together with it; and a pair of side members made of flexible side belts which form the side walls of and travel along with the sheet metal being cast, a part of the pair of the side members being held between the top and bottom belts, the other part being located on the side of one of the top and bottom belts with respect to the sheet metal. The continuous casting device of this invention is characterized in that the pair of side members are formed of flexible side belts.

With this invention, since the lateral sides as well as the top and bottom of the mold are constructed of the flexible belts, the leakage of molten metal from between the belts can be prevented. Furthermore, since one part of the side belts is held between the top and bottom belts and the other part located on the side of either the top or bottom belt with respect to the sheet metal, i.e., the side belts are arranged so that they are led along the curved path on the plane parallel to the belt thickness, the width of the side belts can be widened without giving adverse effect on the bending strain acting on the side belt and regardless of the thickness of the sheet metal being cast.

The above features—the side belt width can be elongated and side belts are held between the top and bottom belts—improves the adhesion between the side belts and the top and bottom belts thus preventing the molten metal from leaking out from between the belts regardless of the kind of material to be cast.

DESCRIPTION OF THE PREFERRED EMBODIMENTS

Figure 1:
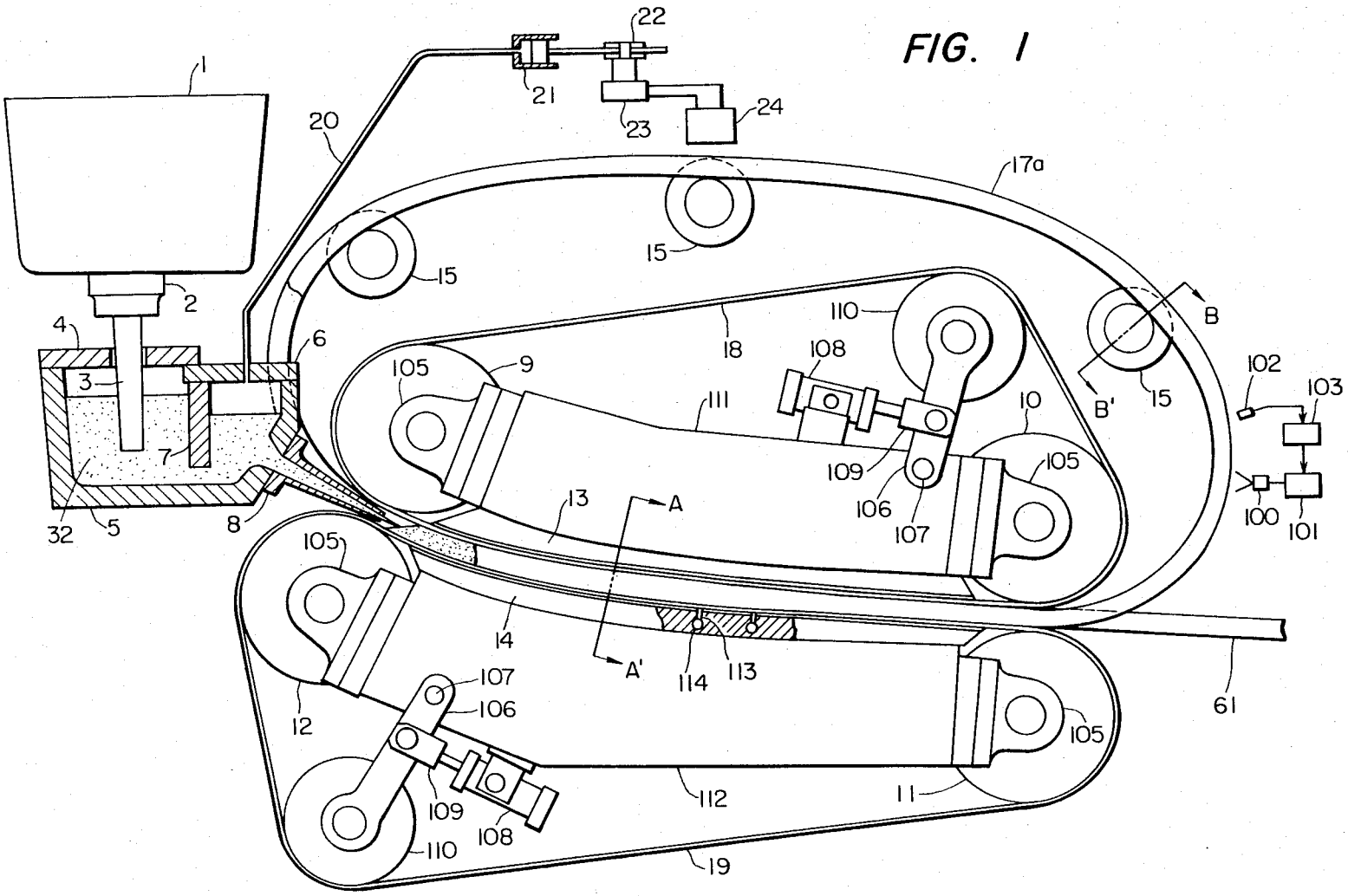
FIG. 1 shows an entire arrangement of the continuous sheet metal casting device embodying the present invention.

One embodiment of this invention is explained in the following referring to the drawings. FIG. 1 shows an entire arrangement of the continuous sheet metal casting device of this invention. In this Figure, the liquid metal 32 in the ladle 1 is poured into the tundish 5 from the sliding gate 2 through the nozzle 3, the flow of the molten metal being controlled by the sliding gate 2. The molten metal 32 is further supplied through the nozzle 8 into the casting machine. The tundish 5 has a partition wall 7 to divide it into two compartments each of which is sealed by the covers 4, 6. The air pressure in that compartment of the tundish in which the nozzle 8 is installed is accurately controlled by pneumatic cylinder 21 through a pipe 20. The pneumatic cylinder 21 is driven by the hydraulic cylinder 22 which in turn is driven by servo valve 23 connected to the hydraulic pressure source 24. This air pressure regulating mechanism enables the precise control of the amount of liquid metal to be poured from the nozzle 8.

The continuous casting machine comprises four belts; i.e., top and bottom belts 18, 19 and side belts 17*a*, 17*b*, all these belts traveling together as the casting process proceeds. The top and bottom belts 18, 19 are fitted around the guide rollers 9, 10, 11, 12 which are supported on the shafts 105. Of these, two guide rollers 10, 11 are rotated by a driving means not shown so that the top and bottom belts 18, 19 travel along with the metal sheet being cast. The tension of the belts 18, 19 is determined by the tension rollers 110 mounted on the lever 106 pivotably supported by the pin 107. The tension of the belts 18, 19 can be adjusted by the cylinder 108 which rotates the lever 106 through the fork end 109.

The static pressure of the liquid metal acting on the top and bottom belts 18, 19 is borne by the static water pressure bearings 13, 14 mounted on the frames 111, 112. The static water pressure bearings 13, 14 work as follows. That is, the cooling water from the water supply holes 114 is injected under high pressure from the nozzles 113 into the gap between the belt 19 and the static water pressure bearing 14 to support and cool the traveling belt 19. This process is also performed in other sections of the static water pressure bearing. Although in this embodiment the static water pressure bearings 13, 14 are formed separate from the frames 111, 112, they may be formed integral with the frames.

Figure 2:
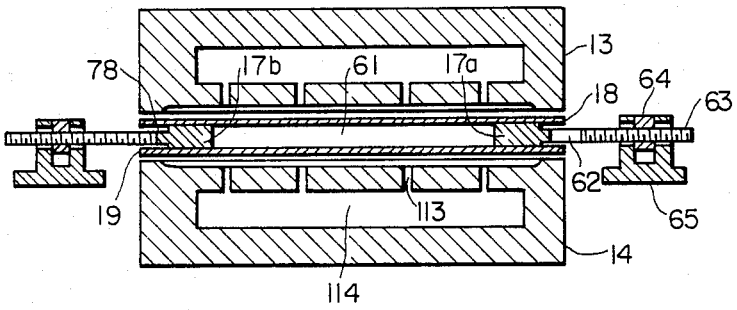
FIG. 2 is a cross section taken along the line A—A′ of FIG. 1.

The side belts 17*a*, 17*b*, as shown in FIG. 2 which is a cross section as seen from the arrow A—A' of FIG. 1, are held between the top and bottom belts 18, 19. The side belts 17*a*, 17*b* have their width greater than the thickness so as to provide a greater adhesion between the top and bottom belts and the side belts and prevent the widthwise deformation.

The inner side of the side belts 17*a*, 17*b*, i.e., the side contacting the sheet metal 61, is parallel to and equal in thickness to the side of the sheet being cast. On the outer side of the side belts there is provided a relief 78 which reduces the thickness of the outer portion of the belts, so that the effect on the side belts of the thermal deformation of top and bottom belts can be minimized and an improved adhesion between the top and bottom belts and the side belts can be obtained.

On the outer side of the side belts inside the mold, there are installed a sliding bearing 62, a screw 63 fixed to the bearing 62, a nut 64 for rotating the screw 63 and a support 65 on which to mount the screw 63. With the sliding bearing assembly it is possible to bear the static pressure of the sheet not yet solidified and therefore restrict the side belts to the desired positions. By rotating the nut 64 by a motor not shown, it is possible to easily adjust the distance between the side belts 17*a*, 17*b* or the width of the sheet.

The side belts traveling out of the mold are led along the curved path of a greater radius than that of the top belt 18 so that the side belts will part from the top belt 18. The side belts are curved in the plane parallel to the thickness and since the thickness is relatively small as compared to the width of the side belts, the strain of the belt caused by repetitive bending can be kept to a minimum. This in turn elongates the life of the side belts. The detail will be explained later on.

Figure 3:
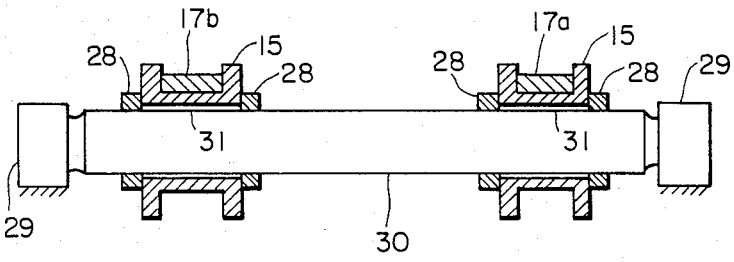
FIG. 3 is a cross section taken along the line B—B′ of FIG. 1.

As shown in FIG. 3 which is a cross section taken along the line B—B' of FIG. 1, the side belts 17*a*, 17*b* are guided and supported by the guide rollers 15. The guide rollers 15 are rotatably mounted on the shaft 30 supported by the bearing boxes 29 with bushing 31 interposed between the guide roller and the shaft. The guide rollers' widthwise position o the shaft 30 is determined by the positioning member 28. It is possible to arrange guide rollers so that they can be moved by cylinders as necessary to give a constant tension on the side belt. The positioning members 28 are used to set the position of guide rollers 15 on the shaft 30 thereby determining the position of the side belts 17*a*, 17*b* and the width of sheet metal 61.

Installed at the rear of the mold are: a spray 100 for spraying cooling water against the side belts; a cooling water supplier 101 for the spray 100; a sensor 102 located behind the spray to detect the temperature of the side belts after being sprayed and a controller 103 which, according to the output from the temperature sensor, so determines the amount of cooling water to be sprayed that the side belt is kept to the required temperature and which sends the signal representing the amount of cooling water to the cooling water supplier 101. It is desired that the temperature of the side belts be kept in the range of 60° C. to 100° C. In this range of temperature the water sprayed against the side belts will evaporate before entering the mold, so that no special device is required for removing water from the belt. The cooled side belts in turn cool the sheet metal being cast in the mold.

With this embodiment, sufficient space can be found for the installation of the side belt cooling means as it is located near the side belt so that it does not touch the top and bottom belts. Therefore, the cooling means can easily be installed.

Now, we will explain the relationship among the belt thickness, the life of belt and the leakage of molten metal. The thickness of the top and bottom belts can be selected regardless of the thickness of the sheet metal. For example, where the thickness of the top and bottom belts is 1.6 mm and the diameter of the guide rollers 9, 10 is 600 mm, the bending strain of the belt will be 0.267%, so small that the reduction in life due to bending fatigue can greatly be reduced. That is, about 100 hours of life for practical use can be assured. On the other hand, the thickness of the side belts depends on the thickness of the sheet metal being cast. In this embodiment the side belts are not fitted around the guide rollers 9, 10 but led away from these guide rollers to form a moderately curved path with greater radius than the guide roller 10 so that the side belts are affected by only a small bending stress. Therefore, if for instance the thickness of the side belt is 9 mm, it is possible to obtain the same longevity as that of the top and bottom belts by setting the radius of the curved path along which the side belts are guided at 1687 mm. As seen in the drawing, the side belts are each seamless in the direction of their travel, that is in their endless direction, which creates the bending stress as they are bent in the endless path by the guide rollers 15. Since in this embodiment the side belts are rotated in the same direction as the top belt 18, the bending strain of the side belt will remain unchanged when the width of the side belt is elongated. This improves the adhesion between the top and bottom belts and the side belts thereby preventing the leakage of molten metal from between the belts.

Figure 4:
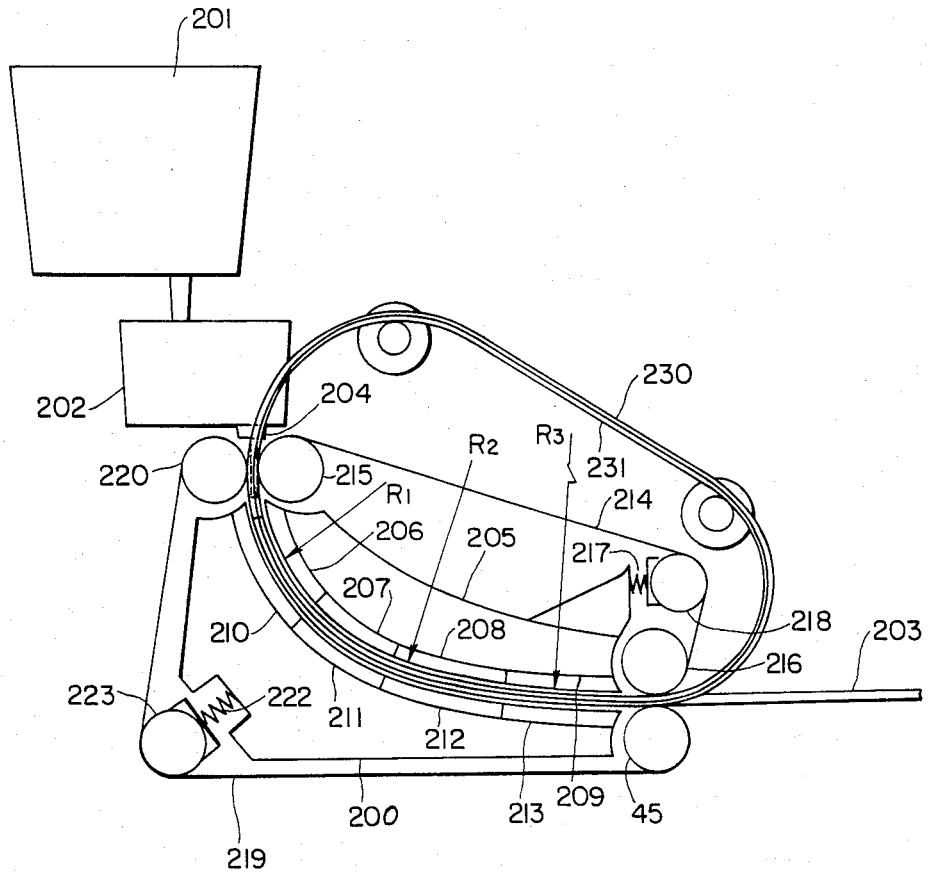
FIGS. 4 and 5 show entire arrangements of other embodiments of this invention.

FIG. 4 shows another embodiment of this invention, in which the liquid metal in the ladle 201 is poured vertically down into the mold through the tundish 202. The sheet metal 203 being cast is drawn through the mold path which is curved near the inlet but progressively straightened toward the outlet of the mold. In this vertical casting the setting of the nozzle 204 is easy as compared with the inclined casting shown in FIG. 1. The static water pressure bearings that support the belts are shaped in such a manner that the radius of each component bearing becomes progressively large, from R1 to R2 and R3, as the location of each bearing goes down from the inlet of the mold toward the outlet. In addition, the static water pressure bearings are divided into two groups, one of which groups consisting of bearings 206 to 209 is installed on the upper frame 205 and the other group consisting of bearings 210 to 213 on the lower frame 200. The above construction makes it possible to reduce the height of the facility, facilitate the machining and installation of the static water pressure bearings and reduce the thermal deformation of each bearing. The top belt 214 travels guided along the guide rollers 215, 216 and the tension roller 218 which is loaded by the spring 217 to restrict the variation in tension. The bottom belt 219 also travels guided along the guide rollers 220, 245 and the tension roller 223 which is loaded by the spring 222.

An important feature of this embodiment is that two belts 230 and 231 are stacked one upon the other to form a single side belt. With this construction the thickness of each component belt can be reduced, resulting in longer life of each component belt and therefore longer life of the side belt as a whole. Hence, by adequate selection of the number of component side belts, it is possible to continuously cast the sheet metal with a thickness of, for example, 30 mm.

Figure 5:
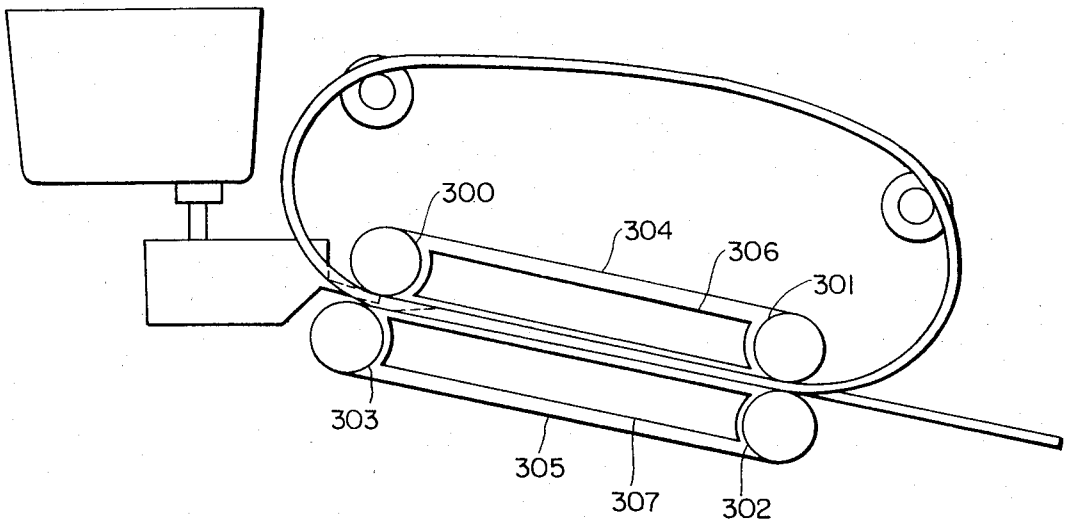

Although the molds of the preceding embodiments are shaped in curve, it is also possible to provide a linear mold, as shown in FIG. 5. In this case the top and bottom belts 304, 305 guided along the guide rollers 300, 301, 302, 303 can be supported on the linear static water pressure bearings 306, 307.

Although in the foregoing embodiments the side belts are made to travel on the upper side with respect to the sheet metal being cast, they can be made to travel on the lower side without affecting the spirit of this invention.

I claim:

1. A continuous sheet metal casting device having a mold, which comprises:

a pair of top and bottom endless, metal, flexible belts forming the top and bottom walls of the mold;

driving means for rotating said top and bottom belts, so that adjacent runs are each traveling in the casting direction;

a pair of flexible opposed side members, each comprising at least two endless, metal, flexible side belts that are stacked together one upon the other in the direction of their thickness along the mold and each side belt having respective sides that are seamless in said direction to form the side walls of the mold and travel along the mold, a first part of the pair of flexible side members being held between the top and bottom belts to form said side walls, a second part of the pair of flexible side members being located outside of the top and bottom belts with respect to the mold, and the width, as measured transverse to said direction, of the flexible side belts being greater than the thickness thereof; and guiding means provided to guide the second part of the side members along a curved path of radius larger than the adjacent radius of said top and bottom belts so that said second part of said side members separates from at least one of the top and bottom belts.

2. A continuous sheet metal casting device as set forth in claim 1 including means to determine and adjust the width of the mold.

3. A continuous sheet metal casting device as set forth in claim 2, wherein the side belts have, on the opposite side of the mold, a relief that reduces their thickness.

4. A continuous sheet metal casting device as set forth in claim 2, wherein the first part of the side members and the part of the top or bottom belt contacting the first part of the side members are curved together in the same direction to form the mold.

5. A continuous casting device as set forth in claim 2, wherein a means is provided on the opposite side of the top and bottom belts with respect to the mold to cool and guide these belts, and a means to cool the side members is installed where it can cool the second part of the side belts.

6. A continuous sheet metal casting device as set forth in claim 5, wherein the side belt cooling means include a means to control the temperature of the side belts to a required temperature.

7. A continuous sheet metal casting device as set forth in claim 6, wherein the temperature of the side belts is set somewhere in the range of 60° C. to 100° C.

8. A continuous sheet metal casting device as set forth in claim 1, further including bearing means for supporting said top and bottom flexible belts by static water pressure bearings.

9. A continuous sheet metal casting device having a mold, which comprises:

a pair of top and bottom flexible endless belts mounted for rotation in a common plane with adjacent parallel runs forming the top and bottom walls of the mold;

means for driving said belts so that their adjacent parallel runs travel at the same speed and in the casting direction along the mold;

a pair of first side and second side opposed side members, each comprising at least two flexible, completely separate, endless side belts having respective sides that are seamless in said direction for forming the first side and the second side of the mold, and said side belts being mounted for rotation in planes parallel to each other and parallel to the plane of rotation of said top and bottom belts;

said side members being mounted so as to have parallel runs spaced from each other, and said side member parallel runs being between and in contact with each of said top and bottom flexible belts so as to move therewith along the mold and so that the top, bottom, and side belts form the mold as an endless moving rectangular mold having an inlet end and an exit end;

for each of said side members, said side belts being stacked on each other in the direction of their thickness and being in full engagement throughout their length at least along said mold;

a tundish for holding liquid metal;

means for supplying liquid metal into said tundish;

nozzle means for removing liquid metal from said tundish and feeding said liquid metal into said inlet end of said mold so that the sheet metal may be withdrawn from the exit end of said mold;

means cooling the faces of said top and bottom belts that are opposite from the interior of the mold;

means cooling said side belts;

means guiding and bending said side belts adjacent said mold inlet end and said mold exit end along a radius of curvature substantially greater than the adjacent one of said top and bottom belts so as to be outwardly spaced from and envelope the adjacent one belt at all portions except along said mold so that said side belts are substantially of greater length than their adjacent one belt and so that the bending stresses in said side belts as they bend around said curvature may be reduced as compared to a smaller curvature; and each of said side belts having a width, as measured perpendicular to said direction, that is substantially greater than its thickness.

10. A continuous sheet metal casting device as set forth in claim 9, including automatic means to control the rate that liquid metal passes through said nozzle means.

11. A continuous sheet metal casting device as set forth in claim 10, wherein said cooling means directly engages cooling liquid with each of said belts, and further includes means spraying cooling liquid on said side belts at a position spaced from an adjacent the mold exit end and apart from the mold run.

12. A continous sheet metal casting device as set forth in claim 10, wherein said belt mold runs extend along a curved path curving downwardly from the inlet end towards the exit end; and said cooling means comprise a plurality of top and bottom arcuate bearings directly adjacent to the respective top and bottom belts throughout the entire extent of said top and bottom belts within the mold runs, and said bearings each having nozzle means opening through their surface adjacent said belts for providing a pressurized water film directly between the adjacent surfaces of the bearing and belt for supporting and cooling.

13. A continous sheet metal casting device as set forth in claim 9, including sliding bearings throughout the length of said mold engaging the side of said side belts opposite from the mold interior, and means for adjusting said bearings toward and away from said mold to thereby adjust the width of the mold.

14. A continuous sheet metal casting device as set forth in claim 13, wherein:

each of said side belts has immediately adjacent top and bottom faces parallel to each other and in direct engagement with said top and bottom belts within said mold runs, each of said side belts along said runs having a relief portion extending outwardly from the remainder of said side belts, being of a height substantially less than the distance between said top and bottom belts, being spaced from said top and bottom belts, and being in engagement with said sliding bearings and thereby reducing the effects on the side belts of the thermal deformation within the adjacent edges of said top and bottom belts.

15. A continuous sheet metal casting device as set forth in claim 14, further including a plurality of guide rollers having an outwardly facing channel shape receiving therein said side belts and being mounted on a support shaft for axial movement relative to each other and said shaft, and positioning means adjustably determining the position of said rollers axially on said shaft so as to correspond with the adjusted position of said side belts within said mold.

16. A continuous sheet metal casting device as set forth in claim 9, wherein said cooling means further includes means sensing the temperature of said side belts, means spraying cooling liquid directly against said side belts outside of said mold runs, and controller means responsive to the sensed temperature of said side belts and controlling the quantity of liquid sprayed against said side belts to maintain the temperature of said side belts within the range of 60° C. to 100° C.

* * * * *